United States Patent [19]

Hashimoto

[11] 3,971,616

[45] July 27, 1976

[54] ELECTRICAL PARALLEL CONNECTOR

[76] Inventor: Syunichi Hashimoto, 36-24, Higashiryoke, 2-chome, Kawaguchi Saitama, Japan

[22] Filed: May 8, 1975

[21] Appl. No.: 575,660

[30] Foreign Application Priority Data

June 11, 1974 Japan ..... 49-66951

[52] U.S. Cl. ..... 339/98

[51] Int. Cl.[2] ..... H01R 13/38

[58] Field of Search ..... 339/95, 97–99

[56] References Cited

UNITED STATES PATENTS

| | | | |
|---|---|---|---|
| 3,836,944 | 9/1974 | Lawson | 339/99 R |
| 3,865,460 | 2/1975 | Cherney et al. | 339/98 |
| 3,890,029 | 6/1975 | Izraeli | 339/98 |

FOREIGN PATENTS OR APPLICATIONS

| | | | |
|---|---|---|---|
| 544,048 | 1/1956 | Belgium | 339/99 R |

*Primary Examiner*—Joseph H. McGlynn
*Attorney, Agent, or Firm*—Ostrolenk, Faber, Gerb & Soffen

[57] ABSTRACT

An electrical parallel connector comprising an integral unitary structure formed of electrical insulation hard synthetic resin and including a rectangular first connector member and a rectangular second connector member integrally connected to said first connector member by means of flexible connection strips, said first connector member having a plurality of parallel grooves extending by a substantial portion of the length of the connector member in one major surface thereof and terminating short of the opposite ends of the connector member to provide end walls which define the opposite ends of said grooves, projections on the opposite sides of said connector member for engaging the opposite sides of the second connector member, recesses in the opposite side edges of said connector member positioned adjacent to and inwardly of said projections and extending into the bottom of the adjacent groove at right angles to the groove and an intermediate recess positioned between said first mentioned recesses and extending into the bottoms of the adjacent grooves; and said second connector member having a plurality of parallel grooves extending by a substantial portion of the length of the connector member in one major surface of the connector member and terminating short of the opposite ends of the connector member to provide end walls which define the opposite ends of the grooves, the number of said grooves in the second connector member corresponding to that of said grooves in the first connector member, projections at the opposite side edges of the second connector member projecting outwardly of the major surface for engaging in said recesses in the opposite side edges of said first connector member and a recess extending between said side edge projections of the second connector member and intersecting said grooves in the second connector member at right angles thereto; further including an electrically conductive connecting blade engaging in said recesses in the first and second connector members and covered wires received in said grooves in the first and second grooves and held in position by said blade.

1 Claim, 6 Drawing Figures

ELECTRICAL PARALLEL CONNECTOR

BACKGROUND OF THE INVENTION

This invention relates to an electrical connector and more particularly, to an electrical parallel connector for instantly connecting the ends of parallel covered wires.

There have been proposed and practically employed a great variety of electrical connectors and one of the conventional electrical connectors includes a connecting blade having a substantially E-shape and the adjacent prongs of the blade are adapted to pierce to the conductive cores of each of the covered wires on the opposite sides of the wire to thereby electrically connect the cores of the wires to each other. However, such a prior art connecting blade frequently causes the disconnection of the wires and sometimes fails to electrically connect the wires with desired precision.

SUMMARY OF THE INVENTION

Therefore, the present invention is to provide a novel and improved parallel electrical connector which can effectively eliminate the disadvantages inherent in the prior art electrical connectors.

In one preferred embodiment of parallel electrical connector according to the present invention, the connector comprises an integral structure formed of electrical insulation hard synthetic resin and includes a first connector member and a second connector member having the same size and shape as the first connector member and connected to the first connector member by flexible connection strips.

The adjacent major surfaces of the first and second connector members are provided with a corresponding member of grooves of semi-circular cross-section which extend by a substantial portion of the length of the associated connector members and terminate short of the opposite ends of the connector members with the distance between one end of each groove and the adjacent end of the associated connector member being greater than that between the other end of the groove and the adjacent end of the associated connector member to thereby provide a thicker end wall and a thinner end wall for the groove at the opposite ends of the associated connector member, respectively. Covered wires are inserted into the semi-circular cross-section grooves in one of the connector members and the first and second connector member are then put together to hold the wires within the mating grooves in the connector members. The wires are inserted into the grooves at the end of the one connector member where the thinner end walls are formed by depressing down or breaking the thinner end walls and the material of the depressed or broken thinner end walls surround the wires closely to serve as seals or packings between the wires and grooves to thereby prevent displacement and/or disconnection of the wires while the thicker end walls serve as abutments against which the ends of the wires received in the grooves contact whereby the interior of the complete connector is electrically insulated from exterior and dust and the like are prevented from entering the connector.

According to the present invention, there has been provided an electrical parallel connector comprising an integral unitary structure formed of electrical insulation hard synthetic resin and including a rectangular first connector member and a similarly shaped second connector member integrally connected to said first connector member by means of flexible connection strips, said first connector member having a plurality of parallel grooves extending by a substantial portion of the length of the connector member in one major surface of the connector member and terminating short of the opposite ends of the connector member to provide end walls which define the opposite ends of the grooves with the distance between one end wall of each of the grooves and the adjacent end of the connector member being greater than that between the other end wall of the groove and the adjacent end of the connector member to make the one end wall thicker than the other end wall, projections on the opposite sides of the associated connector member projecting outwardly of said major surface of the connector member for engaging the opposite sides of said second connector member, first recesses in the outermost side walls of said grooves extending across the side walls into the bottoms of the grooves and positioned adjacent to and inwardly of said projections and a second recess positioned between said first recesses and extending across the common inner wall of said grooves into the bottoms of the adjacent grooves; and said second connector member having a corresponding number of parallel grooves extending by a substantial portion of the length of the connector member in one major surface thereof and terminating short of the opposite ends of the connector member to provide end walls which define the opposite ends of the grooves with the distance between one end wall of each of the grooves and the adjacent end of the connector member being greater than that between the other end wall of the groove and the adjacent end of the connector member to make the one end wall thicker than the other end wall, projections at the opposite side edges of the connector member projecting outwardly of said major surface of the second connector member for engaging in said first recesses in the first connector member and a recess extending between said projections of the second connector member across the bottoms of the grooves in the second connector member; further including a substantially W-shaped connecting blade having alternate prongs and pointed piercing projections received in said first and second recesses in the first connector member and the recess in the second connector member and covered wires received within the mating grooves in the first and second connector members and pierced by said pointed piercing projections.

The above and other objects and attendant advantages of the present invention will be more readily apparent to those skilled in the art from a reading of the following detailed description in conjunction with the accompanying drawing which shows one preferred embodiment of the invention for illustration purpose only, but not for limiting the scope of the same in any way.

BRIEF DESCRIPTION OF THE DRAWING

The accompanying drawing shows one preferred embodiment of electrical parallel connector constructed in accordance with the present invention in which.

PREFERRED EMBODIMENT OF THE INVENTION

Figure 1:
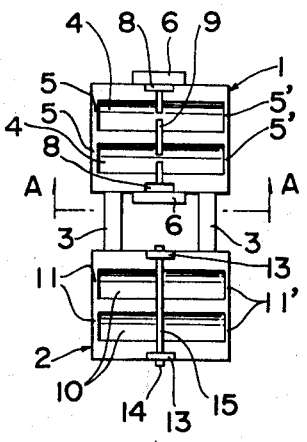
FIG. 1 is a developed plan view of the connector prior to the assembly of the first and second connector members of said connector.
Figure 4:
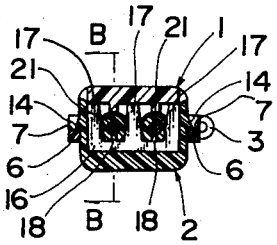
FIG. 4 is a vertically sectional view of the complete connector having covered electric wires held in position therein.
Figure 6:
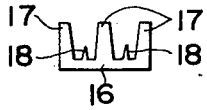
FIG. 6 is an elevational view of the conductive connecting blade of said connector.
Figure 3:
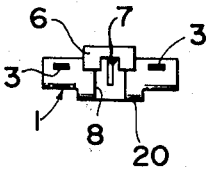
FIG. 3 is a cross-sectional view substantially taken along the line A — A of FIG. 1.
Figure 5:
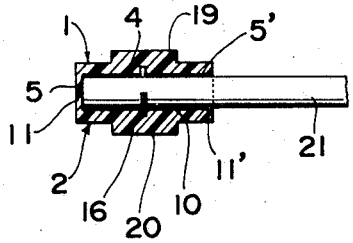
FIG. 5 is a cross-sectional view substantially taken along the line B—B of FIG. 4.

The present invention will be now described referring to the accompanying drawing which shows one preferred embodiment of electrical parallel connector embodying the principle of the invention. First referring to FIG. 1 of the drawing which shows the connector is a developed view prior to the assembly of the first and second connector members. The connector generally comprises an integral unitary structure formed of an electrical insulation hard synthetic resin and includes a first rectangular connector member 1 and a similarly shaped second connector member 2 integrally connected to the first connector member 1 by means of a pair of flexible parallel connection strips 3 and 3 which extend between and are connected at the opposite ends to the adjacent sides of the two connector members. The first connector member 1 is formed in one major surface thereof with a plurality of parallel and spaced grooves 4 and 4 (two grooves in the illustrated embodiment) which extend by a substantial portion of the length of the associated connector member 1 and terminate short of the opposite ends of the connector member to provide end walls 5 and 5' which define the opposite ends of the grooves. The distance between one end of the grooves 4, 4 (the left-hand end as seen in FIG. 1) and the adjacent end of the connector member is greater than that between the other ends of the grooves (the right-hand ends as seen in FIG. 1) and the other end of the connector member so as to make the end walls 5, 5 thicker than the end walls 5'. An engaging projection 6 is provided on each side of the connector member 1 in a midpoint in the length of the member and the projections partially projects outwardly of the grooved major surface of the connector member for the purpose to be described hereinafter. Each of the projections 6 is undercut in the center thereof at 7 to provide an engaging recess (see FIG. 4). Recesses 8 and 8 are provided in the outer side walls of the grooves 4,4 or the opposite side edges of the connector member 1 adjacent to and inwardly of the associated projections 6, 6 and the recesses have a T-shaped cross-section as seen in plan (see FIG. 3) with the leg of the T-shape extending across the outer side wall of the associated groove 4 into the bottom of the groove at right angles thereto. The arm of the T-shaped recess 8 extends through the full height of the connector member 1 while the leg of the T-shaped recess extends from the grooved major surface of the connector member and terminates short of the other major surface of the connector member. An elongated recess 9 is provided across the common inner side wall of the two grooves 4, 4 in alignment with and spaced from the opposite T-shaped recesses 8, 8. The recess 9 partially extends into the bottoms of the two grooves 4,4 at right angles thereto and from the grooved major surface of the connector member to a point short of the other major surface of the connector member in the thickness thereof. However, the elongated recess 9 is not absolutely necessary in the connector of the invention.

Figure 2:
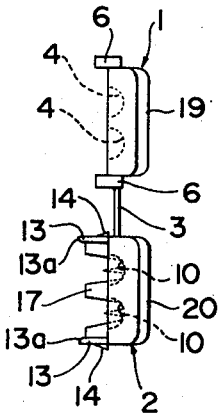
FIG. 2 is a side elevational view of said connector as shown in FIG. 1.

The second connector member has the same shape and size as the first connector member 1 and is substantially symmetrical to the latter. One major surface of the second connector member 2 is formed with a plurality of parallel and spaced grooves 10 and 10 (two grooves in the illustrated embodiment) which extend by a substantial portion of the length of the associated connector member with the opposite ends terminating short of the opposite ends of the member to provide the end walls 11 and 11' of the grooves. As in the case of the first connector member, the distance between one end of the grooves 10, 10 (the left-hand end as seen in FIG. 1) and the adjacent end of the connector is greater than that between the other ends of the grooves (the right-hand end as seen in FIG. 1) and other end of the connector member so as to make the end walls 11 thicker than the end walls 11'. Projections 13 and 13 are provided at the opposite side edges of the connector member 2 in a midpoint in the length of the connector member partially projecting outwardly of the grooved major surface of the associated connector member and the size and orientation of the projections 13, 13 substantially correspond to those of the arms of the mating T-shaped recesses 8 of the connector member 1. The inner surface of the free end portion of each of the projections 13, 13 is given an arched configuration as shown by reference numeral 13a in FIG. 2 so that the projection 13 can be easily engaged in the mating recess 8. Each of the projections 13, 13 is also provided on the outer surface of the base thereof with an engaging boss 14 of triangular shape in cross-section with the apex thereof directing toward the free end of the associated projection 13. A transverse groove 15 is provided at midpoint of the length of the connector member 2 and extends between the opposite projections 13, 13 inter-secting the grooves 10, 10 at right angles thereto. A substantially W-shaped conductive connecting blade 16 is fitted in the transverse groove 15 with the prongs 17, 17 thereof directing away from the grooved major surface of the associated connector member 2. Pointed piercing projections 18 and 18 are provided between adjacent prongs 17, 17 of the connecting blade 16. When held in position, the openings defined by the adjacent prongs 17 of the connecting blade 16 align with the respectively associated grooves 4, 4. The above-mentioned parallel connection strips 3, 3 have a thickness substantially smaller than that of the connector members 1 and 2 and connect the members together at a point inwardly of the major surfaces of the connector members so that the connector members can be easily and manually put together without the use of any tool such as a plier or the like. Although it is not absolutely necessary in the present invention, the other major surfaces or non-grooved surfaces of the first and second connector members 1 and 2 may be formed with thickened portions 19 and 20, respectively, to reinforce the connector members.

In assembling the connector, covered wires 21, 21 are endwise inserted into the grooves 4, 4 at the end of the connector member 1 where the thinner end walls 5', 5' of the grooves are formed until the fore ends of the covered wires contact the end walls 5, 5. The end walls 5', 5' are thin sufficient to yield or break under the force with which the wires 21, 21 are inserted into the grooves 4, 4. When the ends of the covered wires 21, 21 are received in the grooves 4, 4, each of the wires is held in the opening defined by the adjacent prongs 17 of the connecting blade 16. Thereafter, the connecting strips 3, 3 are bent so as to place the first connector member 1 upon the second connector member 2 and the connector members 1 and 2 are then pressed against each other manually or by a suitable tool whereupon the projections 13, 13 engage in the mating arms of the T-shaped recesses 8, 8 and the bosses 14 on the projections 13, 13 engage the projections 6, 6 whereby the two connector members closely fit together. When the connector members 1 and 2 are closely put together in the manner mentioned above, the covered wires 21, 21 are surrounded by the mating grooves 4, 4 and 10, 10 in the first and second connector member 1 and 2 and the covers of the wires are pierced by the pointed piercing projections 18, 18 of the connecting blade 16 so that the cores of the covered wires are electrically connected together. Since the prongs 17, 17 of the connecting blade 16 are received in the legs of the T-shaped recesses 8, 8 and recess 9 in the first connector member 1, the first and second connector members 1 and 2 are positively prevented from displacing relative to each other in the longitudinal direction of thereof. The end walls 12, 12 of the grooves 14, 14 in the second connector member 2 are also thin sufficient to yield or break under the force which is applied thereon when the connector members 1 and 2 are put together in the manner mentioned hereinabove.

As mentioned hereinabove, according to the present invention, since the electrical insulation first and second connector members 1 and 2 are formed in one major surface thereof with a plurality of grooves 4, 4 and 10, 10 respectively one end of which is defined by the thinner yieldable or breakable end wall 5', 5' and end wall 11', 11' while the other ends of the grooves are defined by the thicker end walls 5, 5 and 11, 11, respectively, when the first and second connector members 1 and 2 are put together in the manner mentioned hereinabove with the covered wires 21, 21 interposed therebetween, the thus assembled connector members 1 and 2 are sealed at one end by the contacting end walls 5, 5 and 11, 11 to positively prevent dust and the like from entering the interior of the thus formed connector and electrically insulate the wires 21, 21. Similarly, the other ends of the first and second connector members 1 and 2 are also sealed due to the fact that thinner end walls 5', 5' and 11', 11' yield or break to sealingly surround the wires 21, 21 to thereby act as packings between the associated ends of the connector members 1 and 2 and grooves 5, 5 and 10, 10. Thus, the covered wires 21, 21 are effectively prevented from rubbing against the end walls 5', 5' and 11', 11' to thereby eliminate the possibility of disconnection of the wires. In the foregoing, description has been made of the embodiment in which each of the first and second connector members 1 and 2 is provided with two grooves 4, 4 and 10, 10, respectively, but the number of the grooves may be increased without departing from the spirit of the present invention.

While only one embodiment of the invention has been shown and described in detail, it will be understood that the same is for illustration purpose only and not to be taken as a definition of the invention, reference being had for the purpose to the appended claim.

What is claimed is:

1. An electrical parallel connector comprising an integral unitary structure formed of electrically insulative hard synthetic resin and including a rectangular first connector member and a similarly-shaped second connector member integrally connected to said first connector member by means of flexible connecting strips, said first connector member having a plurality of parallel grooves extending for a substantial portion of the length of the connector member and terminating short of the opposite ends of the connector member to provide end walls which define the opposite ends of the grooves, one end wall of each of the grooves and the adjacent end of the associated connector member being spaced from each other by a distance greater than the distance between the other end wall of the groove and the adjacent end of the connector member to make the one end wall thicker than the other end wall, projections on the opposite sides of the associated connector member projecting outwardly of said major surface for fitting on the opposite sides of said second connector member, first recesses in the outermost side walls of said grooves extending across the side walls into the bottoms of the grooves and positioned adjacent to and inwardly of said projections and a second recess positioned between said first recesses and extending across the common inner side wall of said grooves into the bottoms of the adjacent grooves; and said second connector member having a corresponding number of parallel grooves extending by a substantial portion of the length of the connector member in one major surface thereof and terminating short of the opposite ends of the connector member to provide end walls which define the opposite ends of the grooves in the second connector member, one end wall of each of the grooves and the adjacent end of the connector member being spaced from each other by a distance greater than the distance between the other end wall of the groove and the adjacent end of the connector member to make the one end wall thicker than the other end wall, projections at the opposite side edges of the connector member projecting outwardly of said major surface of the second connector member for engaging in said first recesses in the first connector member and a recess extending between said projections of the second connector member across the bottoms of the grooves in the second connector member; further including a substantially W-shaped electrically conductive connecting blade having alternate prongs and pointed piercing projections received in said first and second recesses in the first connector member and the recess in the second connector member and covered wires received within the mating grooves in the first and second connector members and pierced by said pointed piercing projections.

* * * * *